United States Patent [19]

Russo et al.

[11] 4,071,835

[45] Jan. 31, 1978

[54] RELAY CONTACT CARRIER COATED WITH AN ANTISTATIC MATERIAL

[75] Inventors: Roland Russo, Chagrin Falls; Richard Schneider, Mayfield Heights, both of Ohio

[73] Assignee: Clark Control, Inc., Cleveland, Ohio

[21] Appl. No.: 670,837

[22] Filed: Mar. 26, 1976

[51] Int. Cl.[2] ..... H01H 63/02

[52] U.S. Cl. ..... 335/133; 335/301; 200/302

[58] Field of Search ..... 335/132, 133, 196, 301, 335/6; 200/267, 270, 275, 302

[56] References Cited

U.S. PATENT DOCUMENTS

| | | | |
|---|---|---|---|
| 3,974,468 | 8/1976 | Ygfors | 200/267 X |
| 3,979,704 | 9/1976 | Buckley et al. | 335/6 |

*Primary Examiner*—George Harris
*Attorney, Agent, or Firm*—David M. Keay

[57] ABSTRACT

An electrical relay having a reciprocally driven contact carrier of insulating material on which movable contacts are mounted. The contact carrier is treated with an antistatic surfactant to provide a coating which prevents the buildup of an electrostatic charge. Since a charge does not build up on the contact carrier and the movable contacts, they do not attract nonconducting contaminating materials which otherwise would collect on the surfaces of the contacts interfering with the making of proper electrical connections.

5 Claims, 3 Drawing Figures

RELAY CONTACT CARRIER COATED WITH AN ANTISTATIC MATERIAL

BACKGROUND OF THE INVENTION

This invention relates to electrical circuit making and breaking devices. More particularly, it is concerned with electrical relays in which a buildup of static electricity is prevented from causing the contacts to become contaminated.

Reliable operation of electrical relays requires that an electrical circuit be completed each time relay contacts are brought together. The ability of the contacts to provide proper conduction is dependent upon their surfaces being free of nonconducting films or particles. The presence of nonconducting contaminating materials on the contact surfaces may result in random occurrences of contact discontinuity thereby adversely affecting the reliable operation of a relay.

Typically conventional relays include an insulating contact carrier on which movable contacts are mounted and an insulating support in which stationary contacts are mounted. The contact carrier moves reciprocally within the support causing the movable contacts to make and break electrical connections with the stationary contacts. The contact carrier, support, and other structural elements of the relay as well as the environment in which the relay operates are all possible sources of nonconducting contaminating materials. It has been observed that under operating conditions the reciprocally moving contact carrier very quickly becomes electrostatically charged and the movable contacts which are mounted on the contact carrier also acquire the electrostatic charge. Any dust, dirt, or particles of insulating material in the vicinity of the movable contacts are attracted to them. A film or layer of nonconducting contaminating material builds up on the surfaces of the movable contacts causing unreliable operation of the relay by making high resistance connections between the movable and stationary contacts.

Various techniques have been employed in attempting to overcome the problem of nonconducting contaminating materials at the contact surfaces. A wiping action between the contacts may take place as the contacts engage. Multiple contacts may be employed to provide redundant paths. The surfaces of the contacts may be made irregular as in a waffle pattern. A knife edge or pointed contact element which scores or pierces the contaminating materials may be employed. These mechanical techniques provide varying degrees of success under certain conditions; however, none completely avoids the problem of static electricity causing nonconducting materials to adhere to contact surfaces.

SUMMARY OF THE INVENTION

In an electrical circuit making and breaking device in accordance with the present invention the problem of nonconducting contaminating materials accumulating on the contacts due to static electricity is eliminated by treating the surface of the contact carrier with an antistatic material. The device is a typical electrical relay including a supporting member on which a fixed contact is mounted. A movable contact is mounted on a contact carrier of insulating material. The contact carrier is mounted in the supporting member so as to permit movement between a first position at which the contacts are open and a second position at which the contacts are closed. An operating mechanism coupled to the contact carrier moves the contact carrier between the first and second positions to selectively open and close the contacts. The surface of the contact carrier is treated with or has a coating of an antistatic material whereby a charge of static electricity does not build up on the contact carrier or the movable contact and thus nonconducting contaminating materials are not attracted to the movable contacts.

BRIEF DESCRIPTION OF THE DRAWINGS

Additional objects, features, and advantages of electrical relay devices in accordance with the present invention will be apparent from the following detailed discussion together with the accompanying drawings wherein.

DETAILED DESCRIPTION OF THE INVENTION

Figure 1:
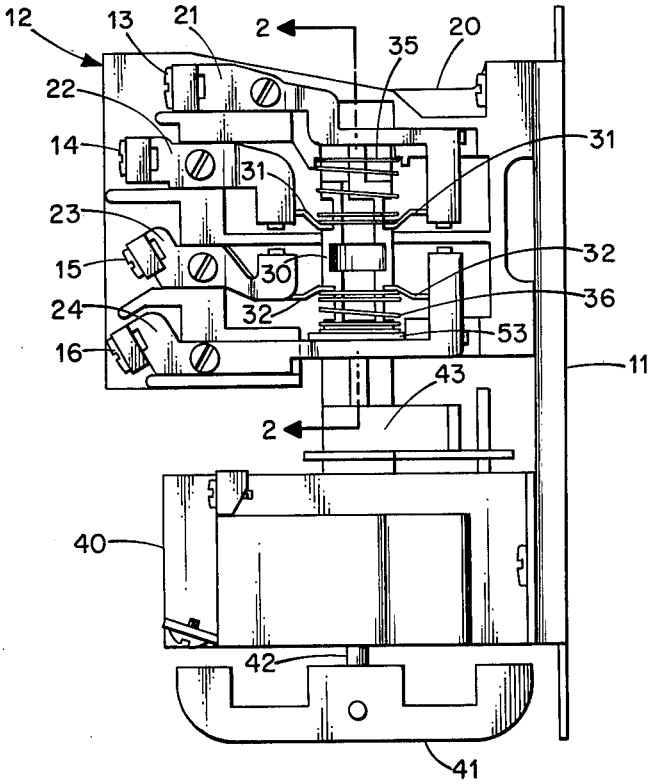
FIG. 1 is an elevational view of a typical electrical relay having a movable contact carrier treated or coated with an antistatic material in accordance with the present invention.
Figure 2:
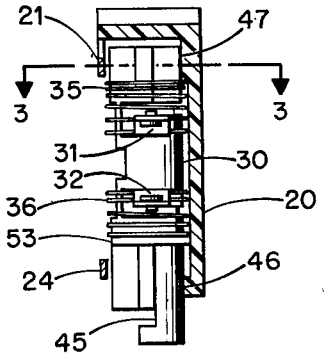
FIG. 2 is a view partially in cross section of a portion of the relay of FIG. 1 taken along line 2—2 of FIG. 1.
Figure 3:
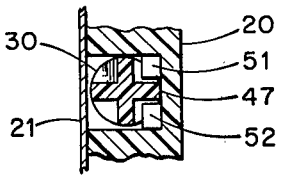
FIG. 3 is a view partially in cross section of a portion of the relay taken along line 3-3 of FIG. 2.

A relay of a generally well-known type incorporating the present invention is illustrated in FIGS. 1, 2, and 3. The relay includes a baseplate 11 on which is mounted a contact assembly 12. Typically several contact assemblies are ganged together, but are mounted on the baseplate in such a way that they are not visible in the view of FIG. 1. The specific contact assembly 12, as shown, includes four electrical terminals 13, 14, 15, and 16 for making electrical connection to appropriate circuitry being controlled by the relay. The terminals are at the ends of conductive bars 21, 22, 23, and 24, respectively, which are mounted in a supporting member or housing 20. The supporting member 20 may be of any suitable insulating material, typically a thermosetting plastic such as a phenolic or melamine. Fixed contacts, which are obscured from view in FIG. 1 by the conductive bars, are mounted on the opposite ends of the conductive bars.

A contact carrier 30 of a suitable insulating material, typically a thermoplastic material and more specifically nylon, is mounted within the supporting member 20 so as to permit reciprocal movement in a vertical direction. The contact carrier 30 supports movable contact arms 31 and 32 which have contacts mounted at each end for engagement with the fixed contacts. The movable contacts are also obscured from view in FIG. 1 by the conductive bars 21, 22, 23, and 24.

The configuration of the supporting member 20 supports the contact carrier 30 and guides it for reciprocal movement between a lower position as illustrated in FIG. 1 and an upper position as illustrated in FIGS. 2 and 3. As shown in FIGS. 2 and 3 the contact carrier has surfaces which bear against raised portions 46 and 47 of the supporting member 20. Conductive bars 21 and 24 retain the contact carrier in the supporting member. Bosses 51 and 52 in the supporting member 20 (FIG. 3) provide a slot for a ridge at the upper end of the contact carrier to prevent the contact carrier from rotating.

With the contact carrier 30 in its lower position as shown in FIG. 1 an upper compression spring 35 bears against the supporting member 20 and urges the upper contact arm 31 downward so that its contacts engage the fixed contacts on conductive bars 21 and 22. A closed circuit is thus produced between terminals 13 and 14. A lower compression spring 36 bears against a ridge 53 on the contact carrier and urges the lower contact arm 32 upward. When the contact carrier 30 is in its lower position as shown in FIG. 1, however, the contacts on the lower contact arm 32 do not engage the fixed contacts on the conductive bars 23 ans 24. Thus, an open circuit is provided between terminals 15 and 16.

When the contact carrier is in the upper position as shown in FIGS. 2 and 3, the movable contacts on the lower contact arm 32 are urged by the lower spring 36 into engagement with the fixed contacts on the conductive bars 23 and 24. The upper contact arm 31 is carried upward compressing the upper spring 35 and moving the upper contacts out of engagement with the fixed contacts on the conductive bars 21 and 22. Thus, when the contact carrier is in the upper position, an open circuit is produced between terminals 13 and 14 and a closed circuit is produced between terminal 15 and 16.

The contact carrier 30 is driven reciprocally between the upper and lower positions in order to selectively open and close the contacts by an electromagnet 40 which is mounted on the baseplate 11. The electromagnet operates a movable armature 41 which is connected to a rod 42 passing through the electromagnet to a coupling arrangement 43. The coupling arrangement 43 engages a notch 45 near the bottom of the contact carrier 30 as best seen in FIG. 2. The coupling member 43 engages similar notches in the contact carriers of each of the contact assemblies which may be mounted on the baseplate 11.

The relay as described briefly hereinabove is a typical electrical relay in which contacts are closed and opened to make and break electrical circuit connections by the operation of the electromagnet 40 and the consequent reciprocal movement of the contact carrier 30 carrying the movable contacts. During operation of the relay the contact carrier 30 slides along the bearing surfaces 46 and 47 of the supporting member 20. It has been found that static electricity builds up on the contact carrier and the charge is distributed by way of the arms 31 and 32 to the surfaces of the movable contacts. As explained previously, various nonconducting materials within the vicinity of the contact carrier are attracted by the electrostatic charge and adhere to the contact surfaces causing unreliable operation of the relay.

In accordance with the present invention the contact carrier 30 is treated to provide an antistatic coating on the surface. More specifically, the contact carrier is treated with an antistatic surfactant to produce an antistatic surface layer. Although both anionic and cationic surfactants have been found to be effective, cationic surfactants appear to provide the best results. A water solution of a quaternary ammonium sulfate - polyether type surface active agent, for example a material manufactured and sold by E. I. duPont deNemours & Company of Wilmington, Del., under the trade name Avitex DN has produced excellent results.

In treating contact carriers of nylon one part by volume of the Avitex DN surfactant as sold commercially is mixed with three parts by volume of water. The solution is heated to a temperature of about 180° F and the contct carriers are immersed in the heated solution for a period of approximately two hours. The contact carriers are subsequently removed from the solution, drained, and then air dried in an oven at a temperature of 200° F for about two hours.

Relays containing contact carriers having their surfaces treated in the foregoing manner have been operated for millions of make and break operations at rates up to 375 operations per minute with no failures caused by nonconducting contaminating materials collecting on the contact surfaces. The manner in which the coating of antistatic material functions to avoid the accumulation of nonconducting contaminating material due to antistatic electricity is not fully understood. Observations and tests indicate, however, that the treatment with antistatic material in the manner described reduces the surface electrical resistivity of the contact carrier to a value which prevents the accumulation of an electrostatic charge and which does not degrade the dielectric characteristics of the insulation system such that it would not meet standard requirements.

While there has been shown and described what is considered a preferred embodiment of the present invention, it will be obvious to those skilled in the art that various changes and modifications may be made therein without departing from the invention as defined by the appended claims.

What is claimed is:

1. An electrical circuit making and breaking device including in combination a supporting member;

a fixed contact mounted in said supporting member;

a movable contact;

a contact carrier of insulating material having the movable contact mounted thereon, said contact carrier being mounted in said supporting member for movement therein between a first position at which said contacts are open and a second position at which said contacts are closed;

an operating mechanism coupled to said contact carrier for moving said contact carrier within said supporting member between said first and second positions to selectively open and close said contacts; and a coating of an antistatic material on the surface of said contact carrier whereby a charge of static electricity does not build up on the contact carrier or the movable contact.

2. An electrical circuit making and breaking device in accordance with claim 1 wherein said antistatic material is an antistatic surfactant.

3. An electrical circuit making and breaking device in accordance with claim 1 wherein said antistatic material is an antistatic cationic surfactant.

4. An electrical circuit making and breaking device in accordance with claim 1 wherein said antistatic material is a quaternary ammonium sulfate - polyether type surfactant.

5. An electrical circuit making and breaking device including in combination a supporting member of insulating material;

a fixed contact mounted in said supporting member;

a movable contact;

a contact carrier of insulating material having the movable contact mounted thereon, said contact carrier being mounted in said supporting member for movement therein between a first position at which said contacts are open and a second position at which said contacts are closed; and an operating mechanism coupled to said contact carrier for moving said contact carrier within said supporting member between said first and second positions to selectively open and close said contacts;

the surface of said contact carrier having been treated with a water solution of a quaternary ammonium sulfate - polyether type surfactant.

* * * * *